US011122952B2

(12) United States Patent
Diana et al.

(10) Patent No.: US 11,122,952 B2
(45) Date of Patent: Sep. 21, 2021

(54) SURFACE CLEANING DEVICE WITH AUTOMATED SUCTION CONTROL

(71) Applicant: TTI (Macao Commercial Offshore) Limited, Macau (MO)

(72) Inventors: Patrick Diana, Davidson, NC (US); Douglas M. Rukavina, Concord, NC (US)

(73) Assignee: TECHTRONIC FLOOR CARE TECHNOLOGY LIMITED, Tortola (VG)

( * ) Notice: Subject to any disclaimer, the term of this patent is extended or adjusted under 35 U.S.C. 154(b) by 108 days.

(21) Appl. No.: 16/688,253

(22) Filed: Nov. 19, 2019

(65) Prior Publication Data

US 2020/0077862 A1 Mar. 12, 2020

Related U.S. Application Data

(63) Continuation of application No. 16/220,757, filed on Dec. 14, 2018.

(Continued)

(51) Int. Cl.
*A47L 11/40* (2006.01)
*A47L 7/00* (2006.01)

(Continued)

(52) U.S. Cl.
CPC ..... *A47L 11/4011* (2013.01); *A47L 7/0004* (2013.01); *A47L 7/0009* (2013.01);

(Continued)

(58) Field of Classification Search
CPC .... A47L 11/4011; A47L 11/302; A47L 11/34; A47L 11/4044; A47L 11/4072;

(Continued)

(56) References Cited

U.S. PATENT DOCUMENTS 4,558,823 A 12/1985 Groth
5,748,853 A 5/1998 Deschenes (Continued)

FOREIGN PATENT DOCUMENTS

CN 105361822 A 3/2016
DE 102015100636 A1 7/2016

(Continued)

OTHER PUBLICATIONS

Hoover Platinum Collection F8100900 Owner's Manual, #960009435-01 11/08; 48 pages www.hoover.com.

(Continued)

*Primary Examiner* — Andrew A Horton
(74) *Attorney, Agent, or Firm* — Moore & Van Allen PLLC; Nicholas C. Russell

(57) ABSTRACT

An extractor is provided. The extractor comprises: a base movable along a surface; a handle configured to be gripped by a user to move the base; a nozzle in fluid communication with a suction motor configured to generate a suction airflow through the nozzle; an encoder operable to generate an encoder signal as a first signal based on user-initiated movement of the base along the surface in a forward direction and as a second signal based on movement in a rearward direction; and a controller operatively connected to the encoder and the suction motor, the controller being configured to change a power to the suction motor to a forward power level based on the first signal during operation of the extractor and to a rearward power level based on the second signal during operation of the extractor, wherein the forward power level is less than the rearward power level.

16 Claims, 10 Drawing Sheets

Related U.S. Application Data

(60) Provisional application No. 62/607,099, filed on Dec. 18, 2017.

(51) Int. Cl.

| | |
|---|---|
| ***A47L 9/28*** | (2006.01) |
| ***A47L 11/34*** | (2006.01) |
| ***A47L 11/30*** | (2006.01) |
| ***A47L 5/36*** | (2006.01) |

(52) U.S. Cl.
CPC ..... *A47L 7/0023* (2013.01); *A47L 9/2805* (2013.01); *A47L 9/2842* (2013.01); *A47L 9/2847* (2013.01); *A47L 11/302* (2013.01); *A47L 11/34* (2013.01); *A47L 11/4044* (2013.01); *A47L 11/4072* (2013.01); *A47L 11/4083* (2013.01); *A47L 11/4088* (2013.01); *A47L 5/365* (2013.01); *A47L 11/4016* (2013.01)

(58) Field of Classification Search
CPC ..... A47L 11/4083; A47L 11/4088; A47L 11/4016; A47L 7/0004; A47L 7/0009; A47L 7/0023; A47L 9/2805; A47L 9/2842; A47L 9/2847; A47L 5/365
See application file for complete search history.

(56) References Cited

U.S. PATENT DOCUMENTS

| | | | |
|---|---|---|---|
| 6,108,862 | A | 8/2000 | Frederick et al. |
| 6,131,238 | A | 10/2000 | Weber et al. |
| 6,421,862 | B2 | 7/2002 | Lesco et al. |
| 6,446,302 | B1 | 9/2002 | Kasper et al. |
| 6,681,442 | B2 | 1/2004 | Coates et al. |
| 6,800,140 | B2 | 10/2004 | Hansen |
| 6,832,407 | B2 | 12/2004 | Salem et al. |
| 7,000,285 | B2 | 2/2006 | Conner et al. |
| 7,043,794 | B2 | 5/2006 | Conner et al. |
| 7,062,816 | B2 | 6/2006 | Kasper et al. |
| 7,076,830 | B2 | 7/2006 | Conner et al. |
| 7,146,679 | B2 | 12/2006 | Coates et al. |
| 7,203,993 | B2 | 4/2007 | Tondra et al. |
| 7,208,892 | B2 | 4/2007 | Tondra et al. |
| 7,222,390 | B2 | 5/2007 | Cipolla et al. |
| 7,237,298 | B2 | 7/2007 | Reindle et al. |
| 7,237,299 | B2 | 7/2007 | Tondra et al. |
| 7,269,877 | B2 | 9/2007 | Tondra et al. |
| 7,362,064 | B2 | 4/2008 | Coates et al. |
| 7,367,080 | B2 | 5/2008 | Lim et al. |
| 7,392,566 | B2 | 7/2008 | Gordon et al. |
| 7,418,764 | B2 | 9/2008 | Gordon et al. |
| 7,424,766 | B2 | 9/2008 | Reindle et al. |
| 7,599,758 | B2 | 10/2009 | Reindle et al. |
| 7,617,563 | B2 | 11/2009 | Hertrick et al. |
| 7,725,223 | B2 | 5/2010 | Gordon et al. |
| 7,757,342 | B2 | 7/2010 | Gordon et al. |
| 7,758,702 | B1 | 7/2010 | Huffman |
| 7,904,990 | B1 | 3/2011 | Miner |
| 8,349,088 | B1 | 1/2013 | Miner |
| 8,800,106 | B2 | 8/2014 | Bilek et al. |
| 2001/0039684 | A1 | 11/2001 | Kasper et al. |
| 2004/0000023 | A1 | 1/2004 | Hitzelberger et al. |
| 2004/0010884 | A1 | 1/2004 | Hitzelberger |
| 2004/0177473 | A1 | 9/2004 | Abdallah et al. |
| 2004/0221415 | A1* | 11/2004 | Tondra ..... A47L 11/4011 15/320 |
| 2005/0071056 | A1 | 3/2005 | Tondra et al. |
| 2006/0288517 | A1 | 12/2006 | Oh et al. |
| 2008/0276408 | A1 | 11/2008 | Gilbert, Jr. et al. |
| 2009/0165822 | A1 | 7/2009 | Kintz et al. |
| 2013/0180055 | A1 | 7/2013 | Haley et al. |
| 2014/0259510 | A1 | 9/2014 | Conrad |
| 2016/0037983 | A1 | 2/2016 | Hillen et al. |
| 2016/0235268 | A1 | 8/2016 | Choi et al. |
| 2018/0249875 | A1 | 9/2018 | Hooley et al. |

FOREIGN PATENT DOCUMENTS

| | | | |
|---|---|---|---|
| GB | 2485666 | A | 5/2012 |
| GB | 2554780 | A | 4/2014 |
| JP | 2011030668 | A | 2/2011 |

OTHER PUBLICATIONS

International Search Report and Written Opinion for International Patent Application No. PCT/US2018/065754 dated Jun. 12, 2019.
International Search Report and Written Opinion for International Application No. PCT/US2019/058804 completed Feb. 5, 2020.
First Office Action dated Apr. 16, 2021 for Chinese Patent Application No. 201880089636.4.

* cited by examiner

SURFACE CLEANING DEVICE WITH AUTOMATED SUCTION CONTROL

CROSS-REFERENCE TO RELATED APPLICATIONS

This application is a continuation application of U.S. Non-provisional patent application Ser. No. 16/220,757, filed Dec. 14, 2018, which claims benefit of U.S. Provisional Patent Application No. 62/607,099, filed Dec. 18, 2017, the contents of which are hereby incorporated by reference in their entirety.

BACKGROUND

Surface cleaning devices, such as dry vacuums and wet extractors, are used to remove dirt, and other various debris from a surface, such as a carpet or hard floor. Wet extractors typically apply a cleaning fluid or solution to the surface before agitating the surface with a brush and then recover the applied cleaning solution with suction to remove dirt or debris from the surface along with the recovered fluid. Typically, extractors rely on a user to directly activate a distribution of cleaning solution onto the surface to be cleaned via a mechanism, such as by the user pressing or holding a button, trigger, or the like. Relying on user interaction for the distribution of the cleaning solution can lead to a misestimate of an amount of cleaning solution to apply to the surface by either applying too much or too little fluid. Furthermore, actuation of a trigger during prolonged use of the extractor may lead to user fatigue.

BRIEF SUMMARY

An extractor is provided. The extractor comprises: a base movable along a surface to be cleaned; a handle configured to be gripped by a user to move the base along the surface to be cleaned; a nozzle in fluid communication with a suction motor configured to generate a suction airflow through the nozzle; an encoder operable to generate an encoder signal as a first signal based on user-initiated movement of the base along the surface in a forward direction and as a second signal based on user-initiated movement of the base along the surface in a rearward direction; and a controller operatively connected to the encoder and the suction motor, the controller being configured to change a power to the suction motor to a forward power level based on the first signal during operation of the extractor and to a rearward power level based on the second signal during operation of the extractor, wherein the forward power level is less than the rearward power level.

The features, functions, and advantages that have been discussed may be achieved independently in various embodiments of the device and methods described herein or may be combined with yet other embodiments, further details of which can be seen with reference to the following description and drawings.

BRIEF DESCRIPTION OF DRAWINGS

The foregoing and other advantages and features of the disclosure, and the manner in which the same are accomplished, will become more readily apparent upon consideration of the following detailed description of the disclosure taken in conjunction with the accompanying drawings, which illustrate embodiments of the disclosure and which are not necessarily drawn to scale, wherein.

DETAILED DESCRIPTION

Embodiments of the present disclosure now may be described more fully hereinafter with reference to the accompanying drawings, in which some, but not all, embodiments of the disclosure are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Furthermore, operatively coupled components may mean that the components retain at least some freedom of movement in one or more directions or may be rotated about an axis (i.e., rotationally coupled). Furthermore, "operatively coupled" may mean that components may be electronically connected and/or in fluid communication with one another.

It should be understood that a "switch," as used herein, refers to any device used for completing or breaking an electrical or mechanical or fluid connection. A user-interface for a switch may be embodied as a button, lever, dial, touch-screen interface, electronic switch, or the like. The switch may be actuated manually by a user of the surface cleaning device or automatically by a controller, computer, or other electronic interface to enact a change in device operation.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

Figure 1:
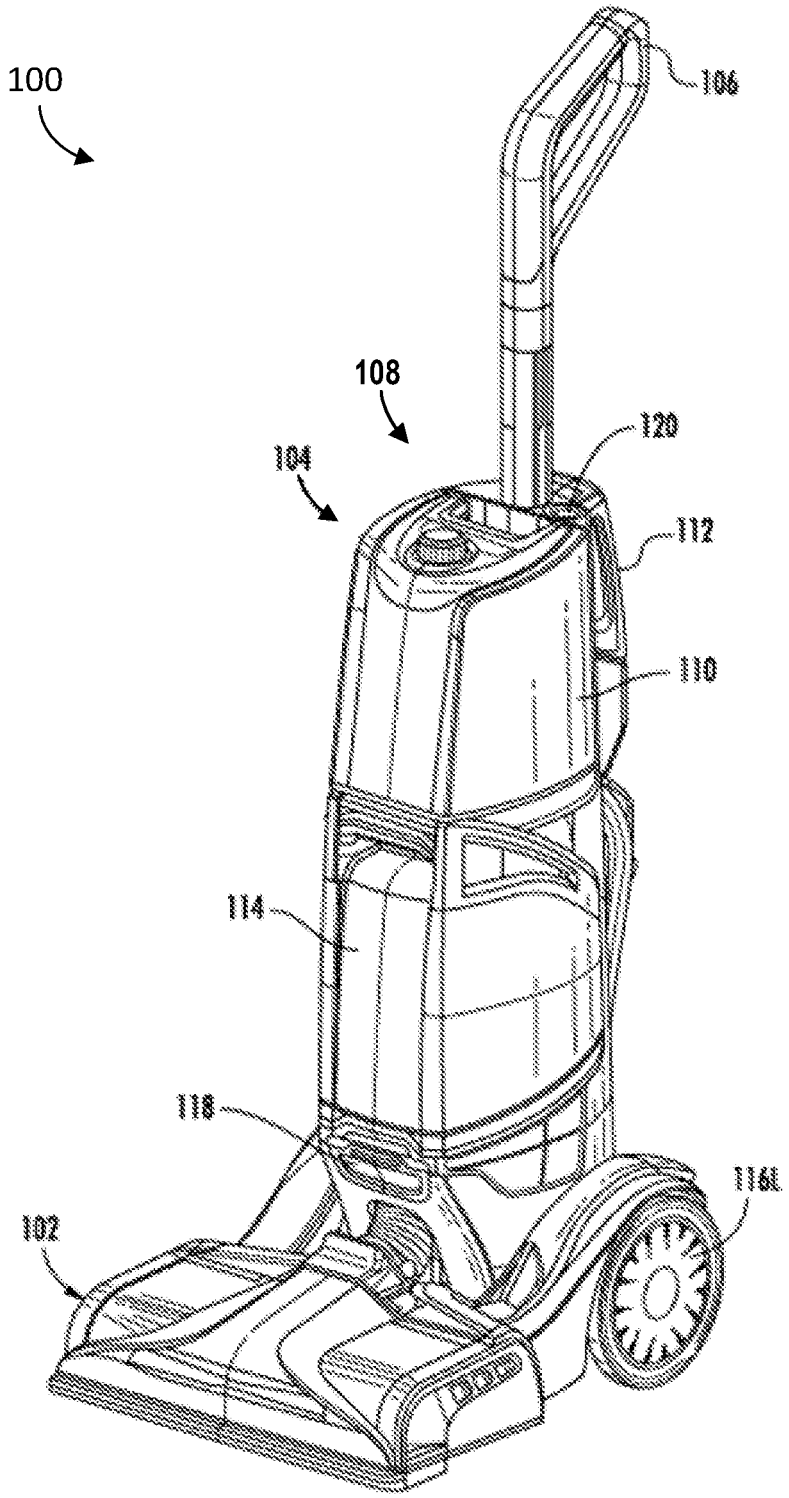
FIG. 1 illustrates a perspective view of a surface cleaning device, in accordance with one embodiment.
Figure 2:
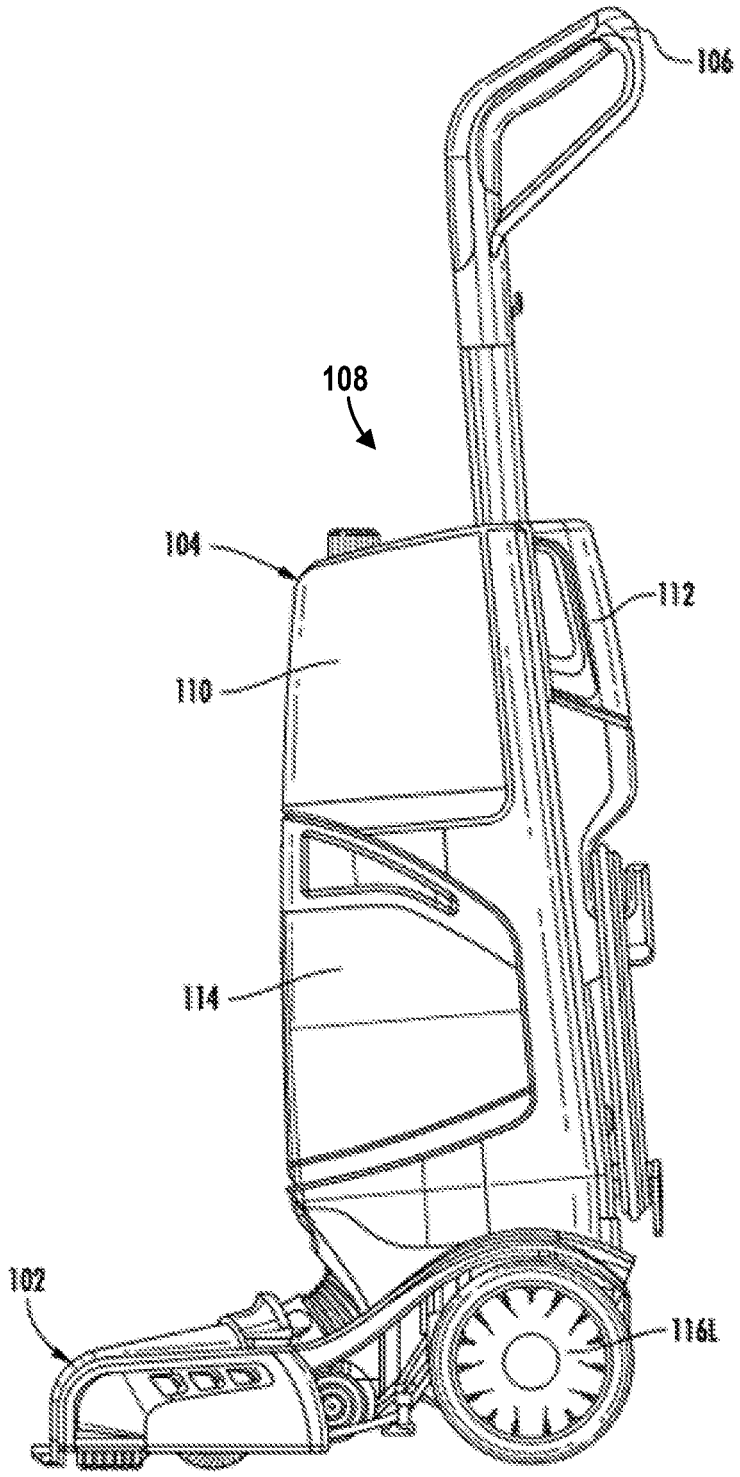
FIG. 2 illustrates a side view of the surface cleaning device, in accordance with one embodiment.
Figure 3:
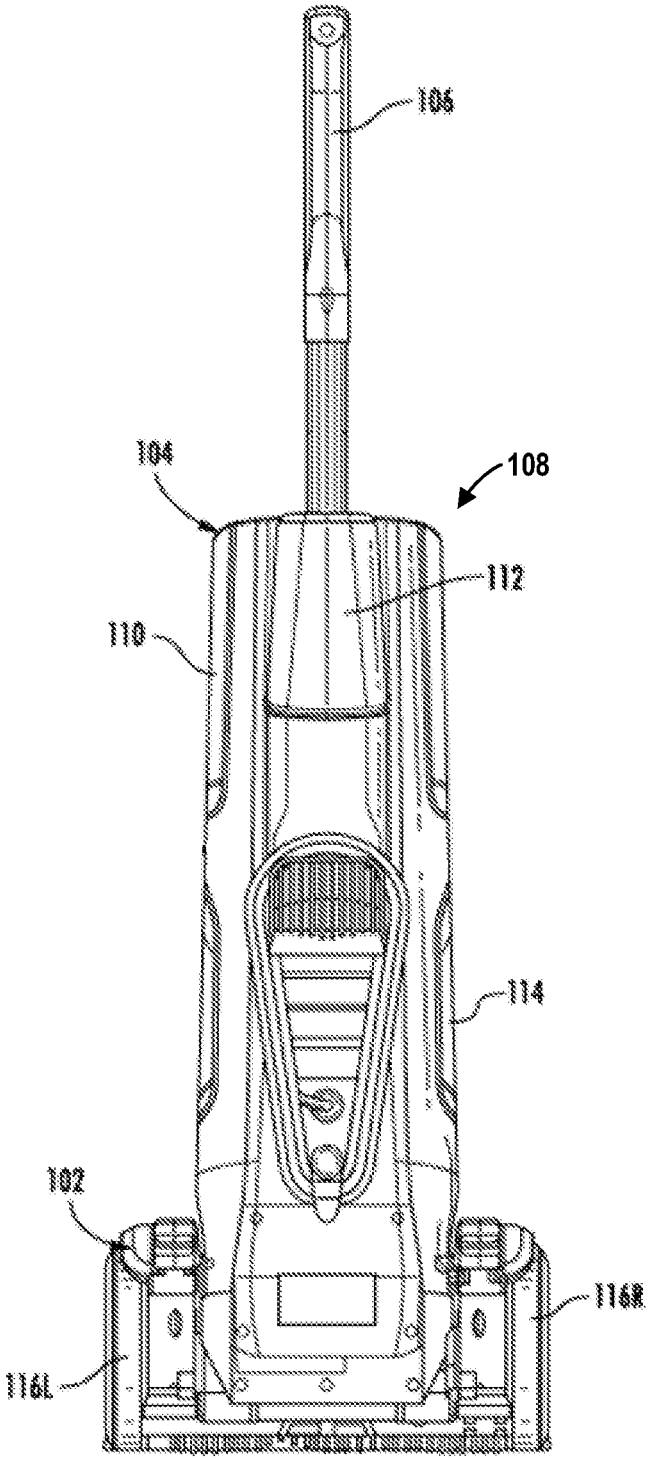
FIG. 3 illustrates a rear view of the surface cleaning device, in accordance with one embodiment.

FIGS. 1-3 illustrate a collection of views of a surface cleaning device, in accordance with one embodiment of the invention. The surface cleaning device, as depicted in the embodiment of FIGS. 1-3, is an upright carpet extractor, specifically a triggerless extractor. Prior upright carpet extractors are generally known in the art such as in commonly owned U.S. Pat. No. 6,681,442, and commonly owned U.S. Pat. No. 7,237,299. Prior extractors require a user to continually actuate a trigger while propelling the extractor to enable distribution of a cleaning solution to a surface to be cleaned. In contrast, the triggerless extractor 100 of the present invention does not rely upon continual actuation of a trigger in the handle or other user interface while propelling the extractor for control or initiation of cleaning solution distribution. In the present triggerless extractor, initiation of the distribution of the solution to the surface is not dependent on continual user actuation of an interface connected to the liquid distribution system. Stated another way, distribution of cleaning solution while propelling the extractor is independent of user interaction other than a user initiated motion (e.g., a forward propelling motion). Instead, the present invention relies on the unique configuration of a controller controlling solution distribution initiation in response to movement of the extractor. As described herein, the controller is configured to operate in a solution distributing mode during movement of the extractor 100 and in a non-distributing mode during movement of the extractor 100, wherein when in the distributing mode, the controller controls the extractor 100 to distribute cleaning solution to the surface, and when in the non-distributing mode, the controller controls the extractor 100 to not distribute the solution to the surface.

As seen in FIG. 1, which illustrates a perspective view of a surface cleaning device, in accordance with one embodiment, the extractor 100 has a base 102 and an upright portion 104, wherein the upright portion 104 is operatively coupled to a portion of the base 102. In the illustrated embodiment, the base 102 further includes a brush assembly (as detailed in FIGS. 4 and 5) for scrubbing and agitating the surface to be cleaned. The upright portion 104 is typically pivotally coupled to the base 102 allowing for pivoting movement of the upright portion 104 about the base 102 in forwards and rearwards directions. The upright portion 104 has a handle 106 for propelling the base 102 over the surface with a pair of wheels 116R and 116L as depicted in FIG. 3, which illustrates a rear view of the surface cleaning device, in accordance with one embodiment. The handle 106 has a grip for engaging with a hand of the user.

As seen in FIG. 2, which illustrates a side view of the surface cleaning device, in accordance with one embodiment, a supply tank assembly 108 is operatively coupled to the upright portion 104 of the extractor 100. In the illustrated embodiment, the supply tank assembly includes a clean water supply tank 110 and a detergent supply tank 112. In some embodiments, the detergent supply tank 112 may be at least partially nested within an open portion formed by the clean water supply tank 110. The clean water supply tank 110 and the detergent supply tank 112 may be positioned on the upright portion 104 adjacent one another or separated from one another, and may be side-by-side or in an above-and-below configuration. In other embodiments, at least a portion of the supply tank assembly 108 may be optionally mounted and/or operatively coupled to the base 102. In one embodiment, the supply tank assembly includes only one tank that the user may fill with solution for washing or clean water for rinsing as desired.

Clean water and/or detergent flow through tubing from the clean water supply tank 110 and the detergent supply tank 112, when present, to form a cleaning solution. In various alternatives, the flow of liquid from the water supply tank 110 and the detergent supply tank 112 may be selectively distributed individually by a valve or series of valves, or may be combined in a mixing valve, a mixing chamber, a selection switch, or other flow control as desired. In the illustrated embodiment, tubing from the water supply tank 110 and the detergent supply tank 112 deliver clean water and detergent, respectively, through a mixing chamber to a valve assembly 506, shown in FIG. 5 and to a pump 414 shown in FIG. 4. In the illustrated embodiment, the valve assembly 506 is enclosed in the housing of the base 102 as depicted in FIG. 5. In other embodiments, the valve assembly 506 may be positioned within or outside of a different portion of the extractor 100.

The liquid is delivered through the tubing routed within the extractor 100 using gravity or routed with the assistance of a pump. In some embodiments, cleaning solution is drawn through the tubing and supplied to a cleaning tool using the pump 414. In some embodiments, the cleaning solution is supplied to a distributer in the base 102 using gravity. In the illustrated embodiment, the cleaning solution of clean water or a mixed cleaning solution (i.e., clean water and detergent when detergent is present) is selectively routed by either the valve assembly 506 to a distributer 410 (as depicted and discussed with respect to FIGS. 4 and 5) or by the pump 414 to a cleaning tool (as depicted and discussed with respect to FIGS. 8A and 8B) via a system of supply tubes. The extractor 100 further includes a recovery tank 114, the details and function of which will be discussed with respect to FIGS. 4 and 5 below.

Figure 4:
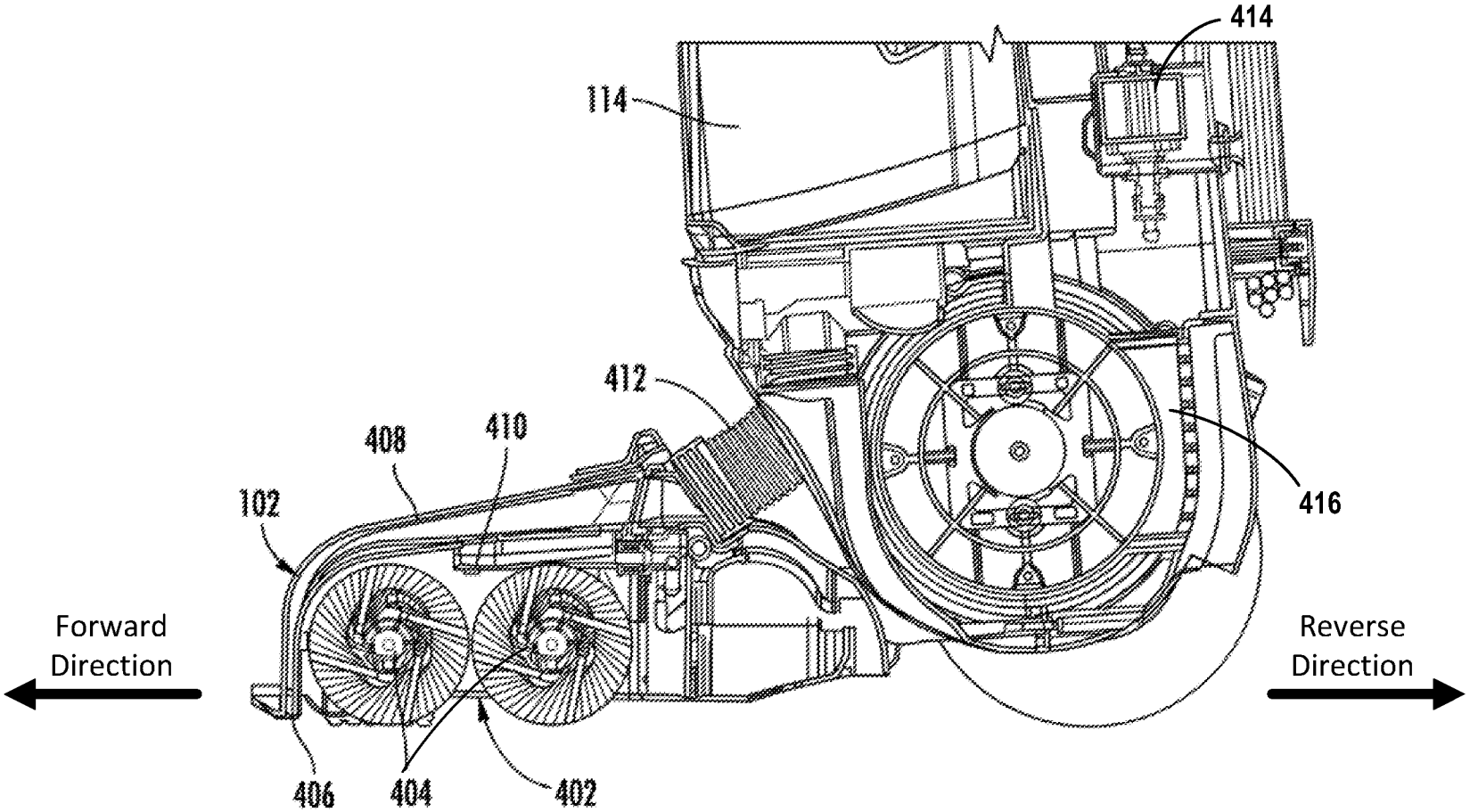
FIG. 4 illustrates a cross-sectional view of a base of the surface cleaning device, in accordance with one embodiment.
Figure 5:
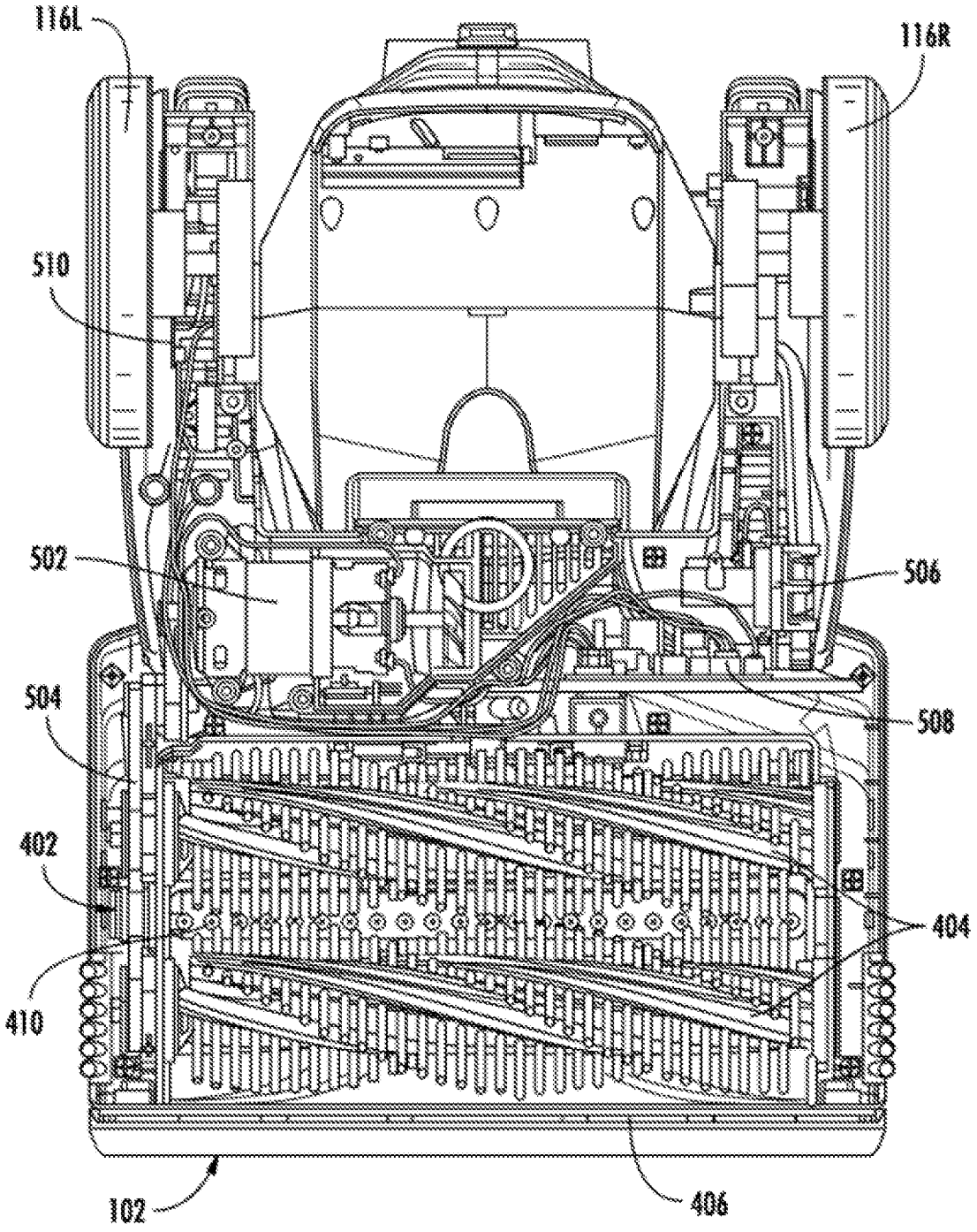
FIG. 5 illustrates a bottom view of the base of the surface cleaning device having a bottom cover removed, in accordance with one embodiment.

FIG. 4 illustrates a cross-sectional view of the base 102 of the surface cleaning device, in accordance with one embodiment of the invention. FIG. 4 further illustrates forward and reverse movement directions of the base 102 along the surface. As illustrated in FIG. 4, the base 102 includes a brush assembly 402 further comprising one or more brushes 404 operatively coupled to the base 102. The one or more brushes 404 are engaged with the surface to agitate dirt and debris to be extracted along with the recovered cleaning solution. While two brushes 404 are illustrated in FIG. 4 for illustration purposes, there may be no brushes 404, one brush 404 or multiple brushes 404 operatively coupled to the brush assembly 402. Alternatively, a cloth, microfiber cloth or roll, squeegee, or other attachment can be employed instead of or in addition to the brush 404.

The base 102 further includes a fluid distributer 410. The distributer 410 distributes the cleaning solution to the surface to be cleaned. The distributor 410 may at least partially distribute the cleaning solution to the one or more brushes 404 of the brush assembly 402. The one or more brushes 404 agitate and scrub the cleaning solution on the surface to dislodge embedded dirt or debris. During operation, the extractor 100 distributes cleaning solution to the surface from the liquid distribution system including the supply tank and distributor, while substantially simultaneously extracting and recovering the applied cleaning solution in a continuous operation.

The applied cleaning solution is extracted from the surface by a suction nozzle 406. In the illustrated embodiment, the nozzle has an inlet at least partially spanning the front portion of the base 102. The suction nozzle 406 is in fluid flow communication with the recovery tank 114 by way of an air duct 408 formed by the base 102. The air duct 408 and the base 102 are operatively coupled to and in fluid communication with the upright portion 104 via an air passage 412 that leads to the recovery tank 114 of the extractor 100. A suction/vacuum source 416 such as a motor and fan assembly (not shown), housed in the upright portion 104 draws air through the nozzle 406 and the formed air passageway of the base 102, through the recovery tank 114 to then exhaust the air to the external atmosphere. In other embodiments, the suction source may be alternatively housed in a different portion of the extractor 100, such as the base 102. In some embodiments, suction may be continuously generated by the suction source during operation of the extractor.

The recovery tank 114 includes an air and liquid separator (not shown), such as one or more baffles or other separator as is understood by one skilled in the art, for separating the liquid (i.e., the recovered cleaning solution) from the air entering the recovery tank 114 and recovering the separated liquid in the recovery tank 114. The recovery tank 114 is removably coupled to the upright portion 104 to allow a user to remove the recovery tank 114 and empty the liquid contents. In other embodiments, the recovery tank 114 may be operatively coupled to one or more other portions of the extractor 100, such as the base 102.

FIG. 5 illustrates a bottom view of the base 102 of the surface cleaning device having a bottom cover of the base 102 removed to provide visibility of the internal components of the base 102, in accordance with one embodiment of the invention. FIG. 5 further depicts the base 102 and brush assembly 402 of the extractor 100. As illustrated, the one or more brushes 404 of the brush assembly 402 rotate under the influence of a brush motor 502 that drives the rotation of the one or more brushes 404 with a belt 504 or, alternatively or additionally, drive gears operatively coupled to the brush motor. In other embodiments, the extractor 100 may not have a separate brush motor, wherein the one or more brushes 404 may instead be driven by a motor of the extractor 100 itself, such as the motor fan assembly as described above. As further illustrated in FIG. 5, the distributer 410 extends at least a portion of the length of the brushes 404 and has a plurality of distribution nozzles for distributing the cleaning solution to the surface and/or the brushes 404 during operation. The base 102 includes the wheels 116L and 116R, which are used to support the extractor 100 and facilitate movement of the extractor 100 over the surface when propelled by the user engaging the handle 106.

Figure 6A:
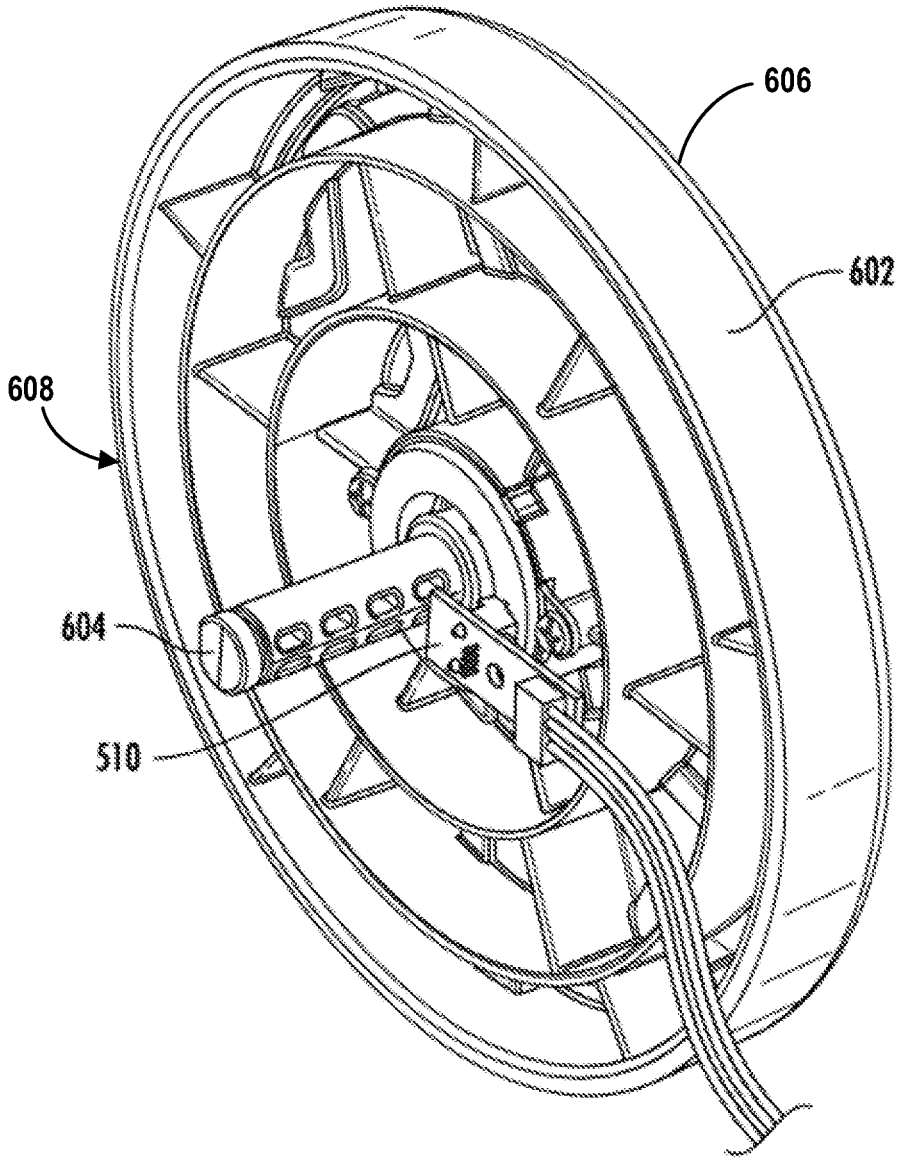
FIG. 6A illustrates a perspective view of a wheel and encoder of the surface cleaning device, in accordance with one embodiment.

FIG. 6A illustrates a perspective view of a wheel and encoder of the surface cleaning device, in accordance with one embodiment of the invention. The wheel 602 may be, for example, the wheels 116R or 116L of the previous figures or a separate wheel used for the purpose of detecting movement and direction of movement.

In the illustrated embodiment, an encoder 510 is operatively coupled adjacent one of the wheels, such as wheel 116L as depicted in FIG. 5. The encoder 510 is configured to sense motion of the extractor 100. The encoder 510 is electronically coupled to a printed circuit board (PCB) controller 508 housed within the extractor 100 (e.g., in the base 102), wherein the controller 508 further comprises a processor, a memory, and a set of computer-based instructions stored in the memory to be executed by the processor for operation and control of components of the extractor 100. In one embodiment, the encoder 510 is configured to sense and determine rotation and direction of the wheel 116L and convert the determined rotation and direction into an electronic signal that is sent to the controller 508. As used herein, the signal may be an output from a single sensor, or may include outputs from two or more sensors. Based on receiving the signal from the encoder 510, the controller 508 is configured to adjust operation of one or more components of the extractor 100. For one example, the controller controls distribution of the solution based on the signal from the encoder during operation of the triggerless extractor. Stated another way, the controller 508 is configured to operate in a distributing mode during movement of the base 102 and in a non-distributing mode during movement of the base 102 based on the signal generated by movement of the base (e.g., a forward and rearward propelling motion) during operation of the triggerless extractor 100. Alternatively, the controller could be an integrated circuit having designed circuit portions to perform the described functions of the controller as described herein.

As previously discussed, the illustrated encoder 510 detects a motion of the extractor 100 along the surface in order to automatically control operations of the extractor 100 (e.g., cleaning solution distribution). For example, in response to detecting forward movement of the extractor 100 (as shown in FIG. 4), the encoder 510 generates a signal, which is transmitted to the controller 508. As further discussed below, the signal in one embodiment includes outputs from two or more Hall Effect sensors. In alternative embodiments, the signal includes output from one Hall Effect sensor or an optical sensor or a switch or other sensor. Based on receiving the encoder signal generated during movement of the base, the controller 508 controls the valve assembly 506 to at least partially open the valve assembly and initiate a flow of cleaning solution to the distributer 410 in the distribution mode for delivery to the surface during movement of the base. In some embodiments, distribution and/or initiation of distribution of the cleaning solution is only dependent on generation of the encoder signal transmitted to and received by the controller 508 during movement of the base. Stated another way, the controller 508 is configured to change from the non-distributing mode to the distributing mode based on the encoder signal and independent of user interaction with the extractor 100 other than the user-initiated movement of the extractor (e.g., a forward and rearward propelling motion). In this embodiment, the controller 508 stops distribution of the solution when the controller 508 does not receive the signal. In one alternative, the controller 508 also changes the power to the suction motor based on the encoder signal, for one example to decrease the amount of suction during forward motion. In another alternative, the controller 508 also changes the control of the brush motor based on the encoder signal, for one example to decrease the rate of rotation, or the direction of rotation, during reverse motion.

Figure 7:
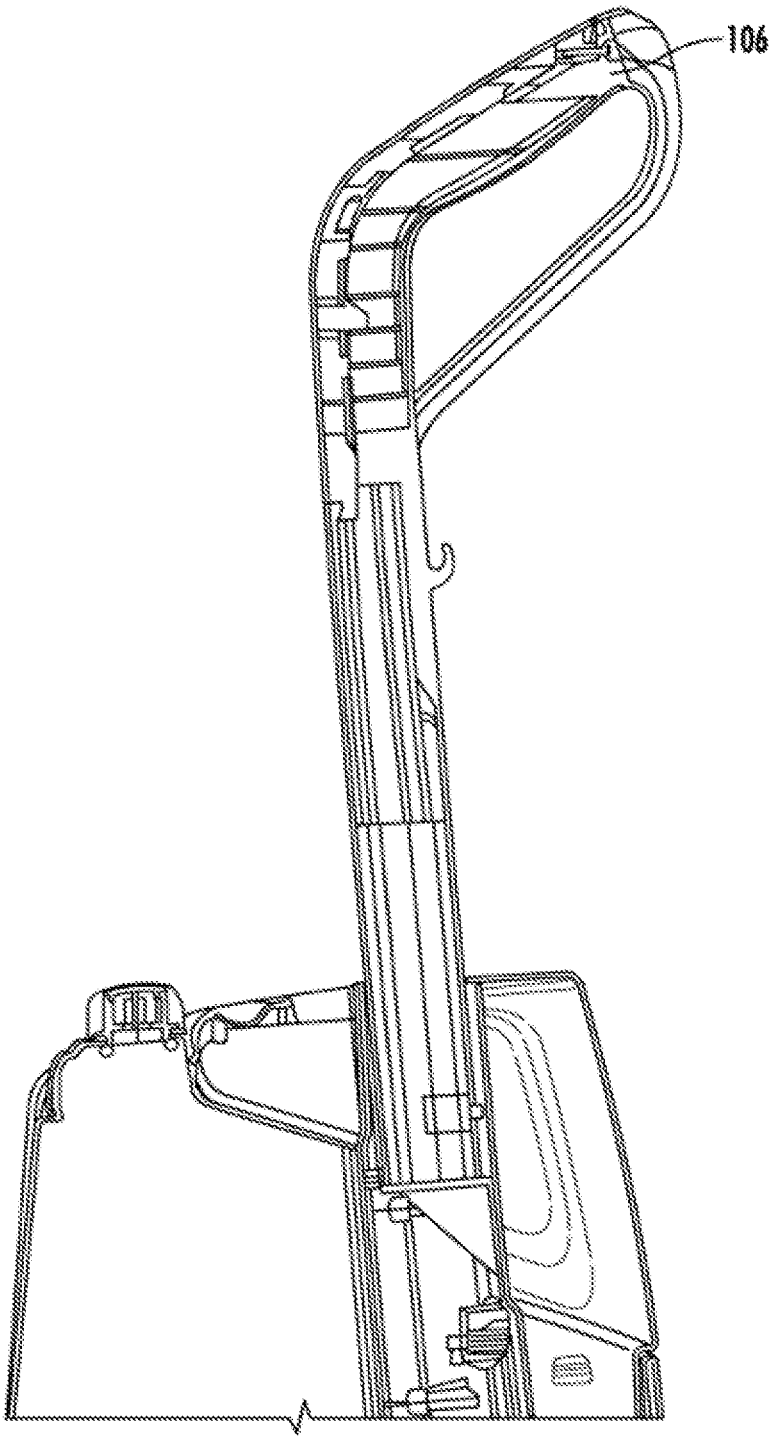
FIG. 7 illustrates a cross-sectional view of a handle of the surface cleaning device, in accordance with one embodiment.

Prior art extractors rely on continual user actuation of a trigger to enable distribution of a cleaning solution to a surface to be cleaned. However, as reinforced by FIG. 7 which illustrates a cross-sectional, internal view of the handle 106 of the surface cleaning device, in accordance with one embodiment of the invention, the extractor 100 of the present invention does not possess or rely upon actuation of a trigger or other user interaction in the handle 106 for control or initiation of cleaning solution distribution. Instead, the present invention relies on the unique configuration of the controller 508 in conjunction with the encoder 510 to control solution distribution initiation. As depicted in FIG. 7, the handle 106 does not include a trigger. In some embodiments, the handle 106 does not include any form of electrical or mechanical switch or other user interaction that requires user input in order to distribute the cleaning solution.

In one embodiment, continued distribution of the cleaning solution to the surface is dependent on the continued generation of the signal by the encoder 510 (i.e., continuous forward movement of the extractor). In the illustrated embodiment, continued distribution of the solution to the surface is based on continued generation of the signal during operation of the triggerless extractor, and the controller stops distribution of the solution when the controller does not receive the signal for a predetermined amount of time, for example ½ second, 1 second, 2 seconds, or any other predetermined amount of time as desired.

As previously discussed, an encoder 510 electronically coupled to the controller 508 is configured to sense motion of the extractor 100. In the illustrated embodiment, the encoder 510 is a rotary encoder operable to sense a rotation and direction of a wheel 602 of the extractor 100 during operation. The wheel 602 is operatively coupled to the extractor 100 via an axle 604 that allows for clockwise or counterclockwise rotation of the wheel about the axle 604 to allow the extractor 100 to be propelled in either a forward or reverse direction (as illustrated in FIG. 4). In some embodiments, each of the wheels 116R and 116L of the extractor 100 have an exterior face 606 and an interior face 608, wherein the interior face 608 is operatively coupled to the extractor 100 via the axle 604. As used herein, a forward rotation refers to a clockwise rotation of the exterior face 606 of the wheel 116R and a counter clockwise rotation of the exterior face 606 of the wheel 116L as viewed from a position looking at the exterior faces of the wheels. Conversely, as used herein, a reverse rotation refers to a counterclockwise rotation of the exterior face 606 of the wheel 116R and a clockwise rotation of the exterior face 606 of the wheel 116L as viewed from a position looking at the exterior faces of the wheels.

Figure 6B:
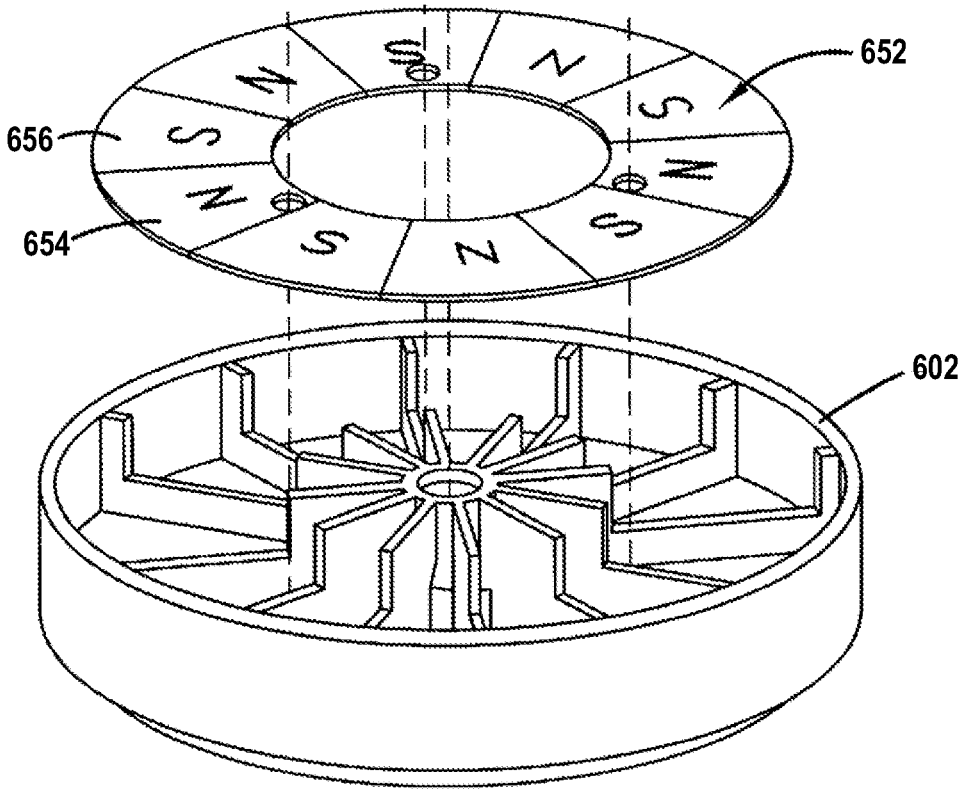
FIG. 6B illustrates a view of a magnetic element and wheel of the surface cleaning device, in accordance with one embodiment.

In one embodiment, such as the illustrated embodiment, the encoder 510 includes two Hall Effect sensors. As seen in FIG. 6B, which illustrates a magnetic element and wheel of the surface cleaning device according to one embodiment, the wheel 602 may include a magnetic element 652 operatively coupled to the wheel 602, wherein the magnetic element 652 further includes one or more negative nodes 654 and positive nodes 656. The magnetic element 652 has a circular or ring-like shape which conforms to the shape of the wheel 602 or at least partially encircles the axle 604. The encoder 510 and controller 508 detect the nodes of the magnetic element 652 as the negative nodes 654 and positive nodes 656 travel past the first and second Hall Effect sensors, each sensor producing an output signal. The Hall Effect sensors are positioned such that the controller 508 determines a rotational direction based on which sensor output it receives first. The controller optionally determines a rate of speed of the wheel 602 based on the frequency of magnetic nodes passing the sensors. The controller 508 uses the signals generated by the sensor detecting the movement of the nodes of the magnetic element 652 in order to determine if the extractor 100 is moving along the surface, wherein a larger number of nodes provides a more accurate determination of a movement state and rotational direction and speed of the wheel 602. In one embodiment, the magnetic element 652 may have twelves nodes. In other embodiments, the magnetic element 652 may have more than twelve nodes. In yet other embodiments, the magnetic element 652 may have less than twelve nodes. Other magnetic or optical encoder arrangements may be used.

To confirm an intentional movement of the wheel 602 along the surface, the controller 508 may analyze one or more signals received from the encoder 510, said one or more signals being produced as a result of negative nodes 654 and the positive nodes 656 moving past the encoder 510 during rotation of the wheel 602. In one embodiment, the controller 508 confirms that the extractor 100 is being intentionally moved forward along the surface only when the controller 508 determines that a predetermined distance of movement occurs within a predetermined amount of time (e.g., at least ten nodes must pass the encoder within two seconds, or other desired rate) indicating forward movement. In response to confirming the forward movement, the controller 508 controls the distributer 410 to distribute the cleaning solution to the surface. Alternatively, a movement of the magnetic element 652 may be determined to be below a predetermined threshold and therefore insufficient to trigger cleaning solution distribution by the controller 508. For example, an insufficient amount of detected movement of the magnetic element 652 may be indicative of merely an unintentional movement or accidental jostling of the extractor 100, wherein a distribution of cleaning solution is not desired.

As an alternative to the rotary Hall Effect encoder discussed in the previous illustrated embodiment, the encoder may be any encoder configured to sense motion of the extractor. In various alternatives, the encoder may sense the relative or absolute position of one or more wheels. In one alternative, the encoder 510 may be a linear encoder, wherein the linear encoder produces a signal based on detected motion along a linear path, such as the extractor 100 traveling along the surface. In another alternative, the encoder 510 is an optical or infrared sensor, wherein the optical sensor detects motion of the extractor 100 based on a collection by the sensor. For example, an optical sensor may detect the absolute or relative position of a wheel based on detecting movement of a visual pattern or apertures applied to a surface of the wheel or other surface associated with the wheel or movement of the extractor. In another example, the optical sensor detects movement along the surface to be cleaned by collecting an image of a surface that the extractor 100 is moving along. In another alternative embodiment, the encoder includes a mechanical member, wherein wheel movement causes movement of a spring or magnetic component of the extractor 100 to move a lever or other member to trigger a switch or Hall Effect sensor for generation of a signal. In yet another alternative, the encoder 510 is a switch that is physically actuated as a result of user-applied force applied to the handle causing movement of the extractor 100, the switch triggering generation of a signal to send to the controller 508.

In another embodiment, in addition to detecting movement and direction of movement, the encoder 510 also detects speed of movement of the extractor, for example by monitoring a rotational speed of the wheel 602, wherein the signal generated and transmitted by the encoder 510 to the controller 508 further includes information related to the speed of rotation of the wheel 602. In response to receiving the encoder signal, the controller 508 increases or decreases the rate of distribution of cleaning solution according to a respective increase or decrease of the speed of forward movement, e.g. speed of rotation of the wheel 602, during operation of the triggerless extractor. In one embodiment, the valve assembly 506 is configured to provide a variable flow rate (e.g., with a control valve) and to vary the size of a flow passage opening from the valve assembly 506 to the distributer thereby providing the variable flow rate. The variable flow rate may be provided in predetermined increments in response to predetermined incremental changes in speed, or may be variable over a substantially continuous range of flow rates correlated to vary with a predetermined range of speeds to allow for highly tailored, operation-dependent solution flow rates. In this way, the controller 508 may control the valve assembly 506 to provide a desired rate of distribution of the solution to the surface based on speed (e.g., a desired amount of cleaning solution applied per linear foot of the traversed surface). In one embodiment, the controller 508 calculates and delivers a cleaning solution distribution flow rate or amount based on speed, wherein a calculation may be based on the signal and/or , optionally, one or more predetermined equations, relationships, look-up tables, or the like stored in the memory of the controller 508. Providing a variable cleaning solution distribution reduces application of either an excess of or a deficiency of cleaning solution to the surface. Additionally, by incorporating the triggerless design as described herein, user error may be essentially eliminated or drastically reduced through automation of the cleaning solution distribution.

In yet another embodiment, a second signal may be generated by the encoder 510 in response to detecting a reverse motion of the extractor 100 or a reverse rotation of the wheel 602. In this embodiment, the controller stops distribution of the solution when the controller does not receive the encoder signal generated by movement of the base for a predetermined amount of time or upon receiving the second signal indicating the reverse extractor 100 movement or reverse rotation of the wheel 602. In response, the controller 508 closes the valve assembly 506 to interrupt or discontinue the distribution of the cleaning solution to the surface in a non-distributing mode during movement of the base 102 while maintaining suction. Stated another way, the controller 508 is configured to change from the distributing mode to the non-distributing mode based on the encoder signal and independent of user interaction with the extractor 100 other than the user-initiated movement of the extractor (e.g., a forward and rearward propelling motion). In one alternative, the controller changes the power supplied to the suction motor when receiving the second signal, for example to increase the amount of suction during the reverse movement stroke. In some embodiments, user actuation of a switch may generate a third signal which, upon being received by the controller 508, overrides the first signal or the second signal to interrupt the distribution of the cleaning solution.

In another embodiment of the invention, the extractor 100 may alternatively or additionally have a second valve assembly (not shown) in fluid communication with the valve assembly 506 and the distributer 402 with tubing. The second valve assembly includes a control valve configured for varying the size of a flow passage from the first valve assembly 506 to the distributer 402 and providing the variable flow rate. The controller 508 is configured to operate the second valve assembly in addition to the first valve assembly 506. In this way, an amount and/or rate of cleaning solution delivered to the distributor 402 for application to the surface can be varied and controlled. In this instance where the first valve assembly 506 metes out only clean water, the controller could control the second valve assembly to vary the output of clean water by a desired dispense amount or flow.

In another embodiment, the extractor 100 further includes a switch 120 (as depicted in FIG. 1), button, or other form of user interface configured to be manually actuated by the user to selectively discontinue or prevent the flow of cleaning solution to the distributor 410 and surface. In this way, the extractor 100 can be propelled forward in an operating state while applying suction without the normal distribution of cleaning solution (i.e., a dry mode). In some embodiments, activation of the switch 120 causes the controller to close the valve assembly 506 to discontinue distribution of solution. In other embodiments, the switch 120 interrupts the generation of the encoder signal by breaking an electrical and/or mechanical connection associated with the controller 508 and/or encoder 510. In a particular example, a user may desire to operate the extractor 100 in the above-described "dry mode" in order to apply suction or agitation to a particular portion of the surface without the distribution of additional cleaning solution.

The switch 120 may be included in a user interface of the extractor 100, wherein the user interface may include one or more switches, buttons, touch screen interfaces, dials, displays, gauges, indicators, lights, or the like for controlling or monitoring one or more functions and operation states of the extractor 100 other than causing distribution of cleaning solution during motion of the extractor (e.g., toggling suction on/off, controlling brush movement, recovery tank fill level, or the like). For example, the user interface may comprise a switch for toggling between high and low suction settings of the extractor 100.

Figure 8A:
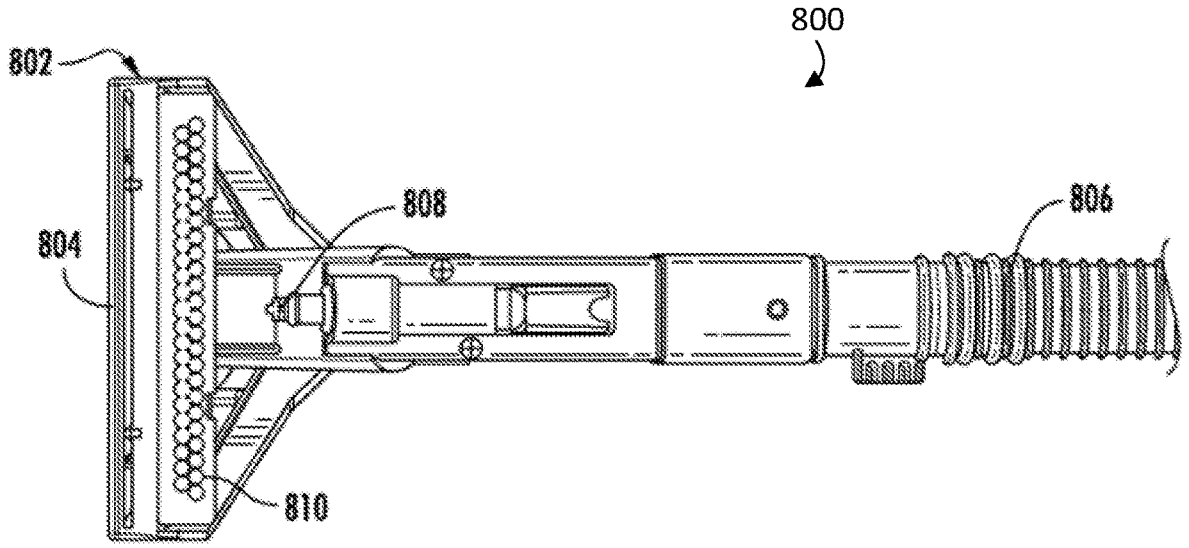
FIG. 8A illustrates a view of a cleaning tool of the surface cleaning device, in accordance with one embodiment.
Figure 8B:
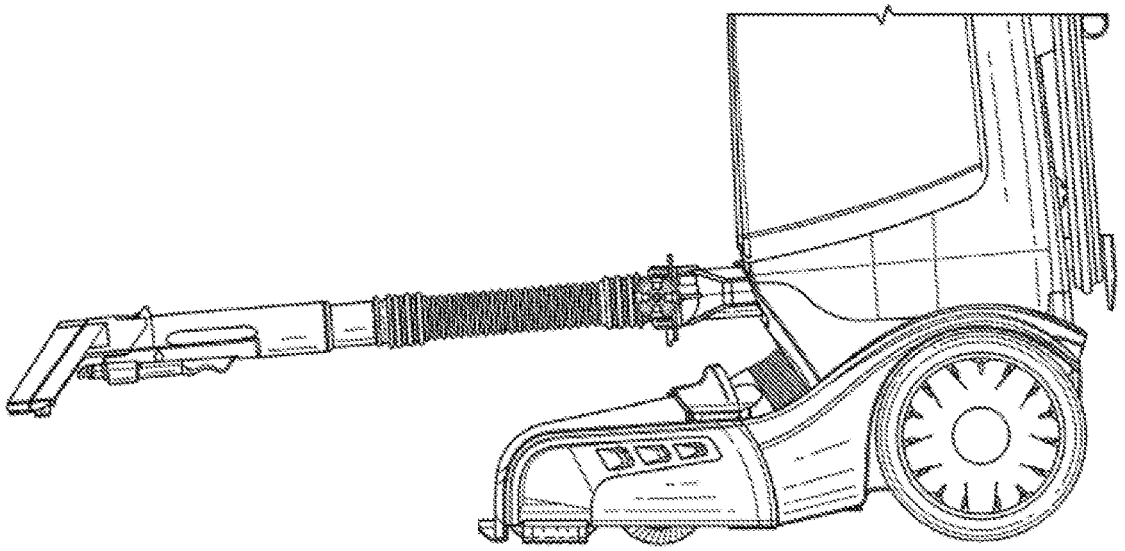
FIG. 8B illustrates a side view of the cleaning tool mounted to the surface cleaning device, in accordance with one embodiment.

FIG. 8A illustrates a view of a cleaning tool of the surface cleaning device, in accordance with one embodiment of the invention. The cleaning tool 800 is configured to be operatively coupled to a sealable connection port 118 (as seen in FIG. 1) of the extractor 100. The connection port 118 includes a fluid distribution line and a suction duct. The cleaning tool 800 has a cleaning head 802 further having a suction inlet 804 in fluid communication with tube 806 which can be operatively coupled to the suction duct of the connection port 118 of the extractor 100 as depicted in FIG. 8B. A distribution nozzle 808 attached to the fluid distribution line of the connection port is in fluid communication with the pump 414 to allow for the distribution of cleaning solution from the pump 414, through the fluid distribution line of the connection port, and to the cleaning tool 800. The cleaning tool 800 may further include a brush 810 for agitating and scrubbing a surface to assist in removing dirt or debris on the surface to be cleaned. Connecting the cleaning tool 800 to the connection port 118 of the extractor 100 reroutes the suction flow path to be in communication with the suction duct of the connection port allowing the cleaning tool 800 to be used for cleaning a surface instead of the base 102. In another embodiment, the cleaning tool 800 includes a motorized brush or brushroll.

Figure 9:
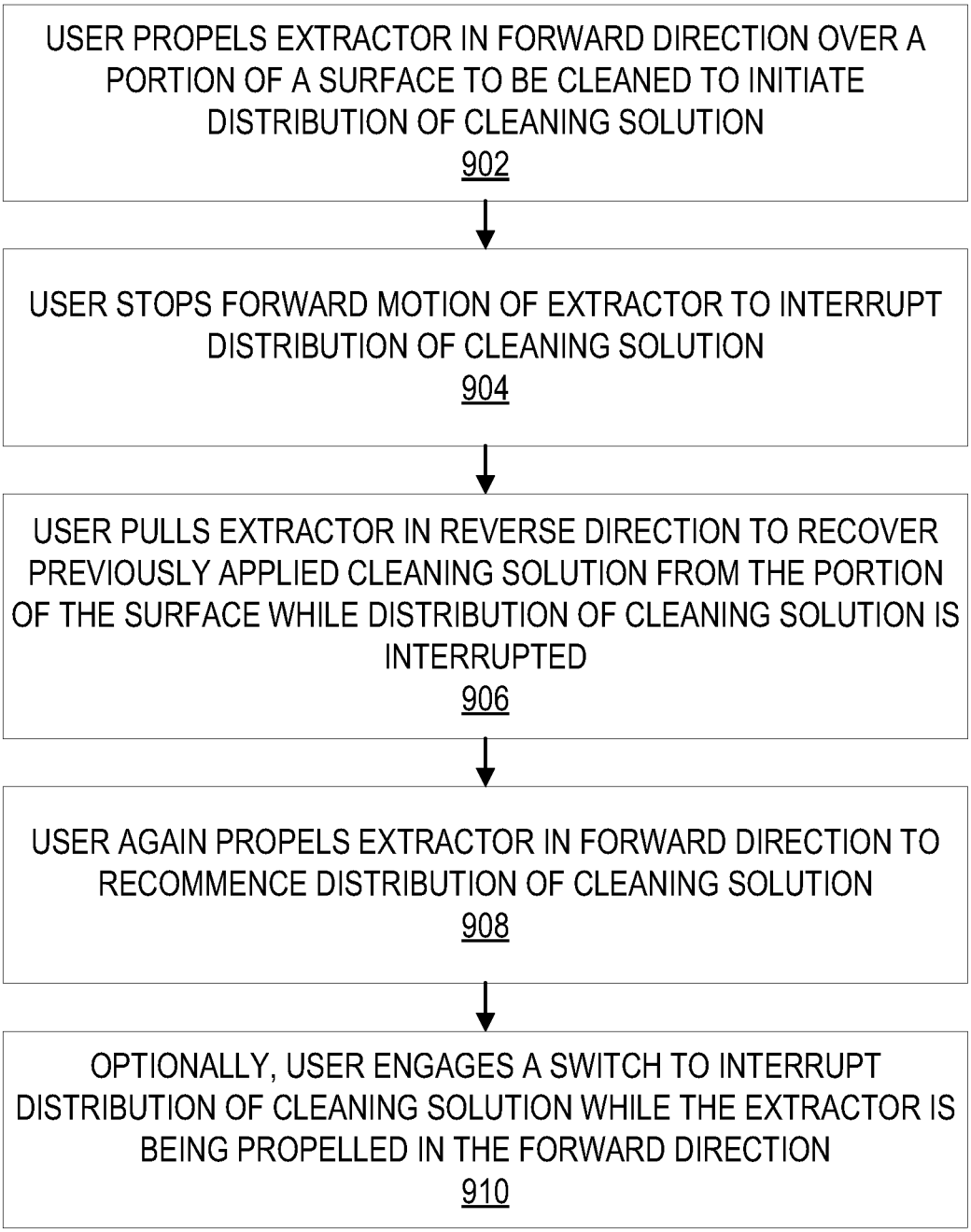
FIG. 9 provides a high level process flow for user operation of the surface cleaning device, in accordance with one embodiment.

FIG. 9 provides a high level process flow for user operation of the surface cleaning device, in accordance with one embodiment of the invention. In block 902, the user powers-on the surface cleaning device (i.e., the extractor 100) and initially propels the extractor 100 in a forward direction over a portion of a surface to be cleaned, the forward motion initiating distribution of the cleaning solution during operation of the extractor 100. The rotation of the wheel 602 of the extractor 100 in the forward direction is detected by the encoder 510 which transmits an encoder signal to the controller 508. In response to the signal, the controller 508 controls the valve assembly 506 to at least partially open and distribute a cleaning solution to the surface. The user continues to propel the extractor 100 in a substantially forward direction over a portion of the surface for continued distribution of cleaning fluid and optionally surface agitation by one or more brushes 404 of the brush assembly 402. Suction is applied by a suction source of the extractor 100 to recover liquid and dirt from the surface. In one alternative, the controller is configured to reduce or omit suction during forward movement of the extractor.

In block 904 of FIG. 9, when the user stops the forward motion of the extractor, the encoder 510 stops transmitting the signal, which causes the controller 508 to interrupt the distribution of the cleaning solution. When the controller 508 determines from the encoder signal that the extractor is not being propelled forward, the controller 508 discontinues distribution of the solution, wherein the controller 508 operates the valve assembly 506 to close and interrupt the distribution of the cleaning solution to the surface.

In block 906 of FIG. 9, the user pulls the extractor 100 in a reverse direction back over the previously travelled portion of the surface to recover the previously applied cleaning solution. When the controller 508 determines from the encoder signal that the extractor is not being propelled forward, the controller does not initiate the distribution of the cleaning solution. Alternatively or additionally, the rotation of the wheel 602 of the extractor 100 in the reverse direction is detected by the encoder 510 which transmits a second signal to the controller 508 and the controller determines reverse movement based on the second signal. In either event, in response to the controller determining that the extractor is not being propelled forward, the controller 508 controls the valve assembly 506 to remain closed to interrupt the distribution of the cleaning solution to the surface. Meanwhile, suction is generated by the suction source, and the previously applied cleaning solution is extracted from the surface along with dirt and debris while the brushes 404 continue to agitate and scrub the surface. In one alternative, the controller is configured to increase suction during reverse movement of the extractor.

In block 908 of FIG. 9, the user again propels the extractor 100 in the forward direction to recommence the distribution of cleaning solution to the surface. The user propels the extractor 100 in forward and reverse strokes to clean the surface, where the controller activates the distribution of cleaning solution during forward strokes and discontinues distribution of cleaning solution during reverse strokes. Optionally, as shown in block 910, the user engages a switch to discontinue the distribution of the cleaning solution while the extractor 100 is being propelled in the forward direction. For example, the user may wish to recover cleaning solution from a particular portion of the surface (e.g., the particular portion of the surface is still damp) to facilitate drying or may wish to concentrate solution extraction and/or agitation on a particular portion of the surface without the distribution of additional cleaning solution.

In one embodiment, a surface cleaning device such as an extractor is provided, the extractor comprising: a base movable along a surface to be cleaned; a liquid distribution system including a supply tank and a distributor in fluid communication to deliver solution to the surface; an encoder operable to generate a signal based on user-initiated movement of the base along the surface; and a controller operatively connected to the encoder and the liquid distribution system, the controller configured to operate in a distributing mode during movement of the base and in a non-distributing mode during movement of the base based on the signal during operation of the extractor, wherein the controller changes from the distributing mode to the non-distributing mode independent of user interaction with the extractor other than the user-initiated movement. In one aspect, the extractor further comprises a handle pivotally coupled to the base having a grip portion without a user interface connected to the liquid distribution system. In another aspect, alone or in combination with any one of the previous aspects or any combination thereof, initiation of the distribution of the solution to the surface is not dependent on continual actuation by a user of a user interface connected to the liquid distribution system. In another aspect, alone or in combination with any one of the previous aspects or any combination thereof, the controller is operable to initiate the distribution of the solution when the signal indicates user-initiated forward movement. In another aspect, alone or in combination with any one of the previous aspects or any combination thereof, the extractor further comprises a switch configured to discontinue a flow of the solution during the user-initiated forward movement. In another aspect, alone or in combination with any one of the previous aspects or any combination thereof, the controller is operable to interrupt the distribution of the solution to the surface when the signal indicates user-initiated reverse movement. In another aspect, alone or in combination with any one of the previous aspects or any combination thereof, the signal is indicative of one or more attributes selected from a group consisting of movement in a forward direction, movement in a reverse direction, and speed of movement. In another aspect, alone or in combination with any one of the previous aspects or any combination thereof, the controller is operable to control a brush motor based on the signal during operation of the extractor. In yet another aspect, alone or in combination with any one of the previous aspects or any combination thereof, the controller is operable to control a suction motor based on the signal during operation of the extractor.

In another aspect, alone or in combination with any one of the previous aspects or any combination thereof, the base further comprises at least one wheel, wherein the distribution of the solution is initiated based on a forward rotation of the at least one wheel, and wherein the distribution of the solution is interrupted based on a reverse rotation of the at least one wheel. In another aspect, alone or in combination with any one of the previous aspects or any combination thereof, the extractor further comprises a valve assembly in fluid communication with the supply tank for selectively delivering the solution. In another aspect, alone or in combination with any one of the previous aspects or any combination thereof, the controller increases or decreases a rate of the distribution of cleaning solution according to a respective increase or decrease of the speed of forward movement during operation of the extractor. In another aspect, alone or in combination with any one of the previous aspects or any combination thereof, continued distribution of the solution to the surface is based on continued generation of the signal during operation of the extractor. In another aspect, alone or in combination with any one of the previous aspects or any combination thereof, the signal includes output from two sensors, wherein the controller is configured to determine the direction of motion based on which sensor output the controller receives first.

In yet another embodiment, a surface cleaning device such as an extractor is provided, the extractor comprising: a base movable along a surface to be cleaned; a handle configured to be gripped by a user to move the base along the surface to be cleaned; a liquid distribution system including a supply tank and a distributor in fluid communication configured to deliver solution to the surface in a distributing mode and to not deliver solution to the surface in a non-distributing mode; an encoder operable to generate an encoder signal as a first signal based on user-initiated movement of the base along the surface in a forward direction and as a second signal based on user-initiated movement of the base along the surface in a rearward direction; and a controller operatively connected to the encoder and the liquid distribution system, the controller being configured to operate the liquid distribution system in the distributing mode during movement of the base based on the first signal during operation of the extractor and in the non-distributing mode during movement of the base based on the second signal during operation of the extractor, wherein the controller changes from the distributing mode to the non-distributing mode based on the encoder signal and independent of user interaction with the extractor other than the user-initiated movement. In one aspect, the handle further comprises a grip portion without a trigger or other user interface connected to the liquid distribution system. In another aspect, alone or in combination with any one of the previous aspects or any combination thereof, distribution of the solution to the surface in the distribution mode is not dependent on continual actuation by a user of a trigger or other user interface connected to the liquid distribution system. In another aspect, alone or in combination with any one of the previous aspects or any combination thereof, the extractor further comprises a switch configured to selectively discontinue flow of the solution during the user-initiated forward movement. In another aspect, alone or in combination with any one of the previous aspects or any combination thereof, the encoder signal is indicative of direction of movement of the base and speed of movement of the base. In another aspect, alone or in combination with any one of the previous aspects or any combination thereof, the base further comprises a rotatable brush operatively connected to a brush motor, wherein the controller controls the brush motor based on the encoder signal during operation of the extractor. In another aspect, alone or in combination with any one of the previous aspects or any combination thereof, the controller increases speed of rotation of the brush based on the first signal during operation of the extractor. In another aspect, alone or in combination with any one of the previous aspects or any combination thereof, the extractor further comprises a liquid recovery system including a suction nozzle and a suction source in fluid communication with the nozzle, the suction source including a suction motor generating airflow through the suction nozzle, wherein the controller controls airflow through the suction nozzle by controlling the suction motor based on the encoder signal during operation of the extractor. In another aspect, alone or in combination with any one of the previous aspects or any combination thereof, the controller increases airflow through the suction nozzle based on the second signal during operation of the extractor.

In another aspect, alone or in combination with any one of the previous aspects or any combination thereof, the base further comprises at least one wheel, wherein the first signal is based on a forward rotation of the at least one wheel, and wherein the second signal is based on a reverse rotation of the at least one wheel. In another aspect, alone or in combination with any one of the previous aspects or any combination thereof, the extractor further comprises a valve assembly in fluid communication with the supply tank and the distributor and operatively connected to the controller for selectively delivering the solution to the distributor. In another aspect, alone or in combination with any one of the previous aspects or any combination thereof, the controller increases or decreases a rate of the distribution of cleaning solution through the valve assembly according to a respective increase or decrease of the speed of forward movement during operation of the extractor. In another aspect, alone or in combination with any one of the previous aspects or any combination thereof, continued distribution of the solution to the surface is based on continued generation of the first signal during operation of the extractor. In another aspect, alone or in combination with any one of the previous aspects or any combination thereof, the encoder signal includes output from two sensors, wherein the controller is configured to determine the first signal and the second signal based on which sensor output the controller receives first.

In another embodiment, a surface cleaning device such as an extractor is provided, the extractor comprising: a base movable along a surface to be cleaned; a liquid distribution system including a supply tank and a distributor in fluid communication to deliver solution to the surface; an encoder operable to generate a signal indicative of user-initiated forward movement of the base along the surface; a controller operatively connected to the encoder and the liquid distribution system, the controller controlling distribution of the solution to the surface based on the signal during operation of the extractor, wherein the distribution of the solution is independent of continual user interaction with the extractor other than the user-initiated forward movement; and a switch configured to selectively interrupt the distribution of the solution to the surface during the user-initiated forward movement. In one aspect, the extractor further comprises a handle pivotally coupled to the base having a grip portion without a user interface connected to the liquid distribution system. In another aspect, alone or in combination with any one of the previous aspects or any combination thereof, the extractor further comprises a valve assembly in fluid communication with the supply tank for selectively delivering the solution. In another aspect, alone or in combination with any one of the previous aspects or any combination thereof, the controller controls a brush motor based on the signal during operation of the extractor. In another aspect, alone or in combination with any one of the previous aspects or any combination thereof, the controller controls a suction motor based on the signal during operation of the extractor.

In another embodiment, a surface cleaning device such as an extractor is provided the extractor comprising: a base movable along a surface to be cleaned; a liquid distribution system including a supply tank and a distributor in fluid communication to deliver solution to the surface; an encoder operable to generate a signal based on user-initiated movement of the base along the surface; and a controller operatively connected to the encoder and the liquid distribution system, the controller being configured to operate in a distributing mode during movement of the base and in a non-distributing mode during movement of the base based on the signal during operation of the extractor, wherein the distribution of the solution is independent of user interaction with the extractor other than the user-initiated movement, wherein the signal is indicative of a speed of rotation of a wheel, and wherein the distribution of the solution is increased or decreased in response to a respective increase or decrease of the speed of rotation of the wheel during operation of the extractor. In one aspect, the controller is operable to initiate the distribution of the solution when the signal indicates user-initiated forward movement of the base along the surface. In another aspect, alone or in combination with any one of the previous aspects or any combination thereof, the controller is operable to interrupt the distribution of the solution to the surface when the signal indicates user-initiated reverse movement of the base along the surface. In another aspect, alone or in combination with any one of the previous aspects or any combination thereof, the distribution of the solution is increased based on a forward rotation of the wheel, and wherein the distribution of the solution is decreased based on a reverse rotation of the wheel. In another aspect, alone or in combination with any one of the previous aspects or any combination thereof, the signal includes output from two sensors, wherein the controller is configured to determine a direction of motion based on which sensor output the controller receives first. In another aspect, alone or in combination with any one of the previous aspects or any combination thereof, the extractor further comprises a valve assembly in fluid communication with the supply tank for selectively delivering the solution.

In yet another embodiment, a surface cleaning device such as an extractor is provided, the extractor comprising: a base movable along a surface to be cleaned; a liquid distribution system including a supply tank and a distributor in fluid communication to deliver solution to the surface; a liquid recovery system including a suction nozzle and a suction source in fluid communication with the suction nozzle, the suction source including a suction motor configured to generate an airflow through the suction nozzle; an encoder operable to generate a signal based on user-initiated movement of the base along the surface; and a controller operatively connected to the encoder, the liquid distribution system, and the liquid recovery system, the controller being configured to operate in a distributing mode during movement of the base and in a non-distributing mode during movement of the base based on the signal during operation of the extractor, wherein the airflow through the suction nozzle is increased or decreased in response to the signal, wherein the signal is indicative of one or more attributes selected from a group consisting of movement in a forward direction, movement in a reverse direction, and speed of movement, and wherein the distribution of the solution is independent of user interaction with the extractor other than the user-initiated movement. In one aspect, the controller is operable to initiate the distribution of the solution when the signal indicates user-initiated forward movement. In another aspect, alone or in combination with any one of the previous aspects or any combination thereof, the controller is operable to interrupt the distribution of the solution to the surface when the signal indicates user-initiated reverse movement. In another aspect, alone or in combination with any one of the previous aspects or any combination thereof, the base further comprises at least one wheel, wherein the airflow through the suction nozzle is decreased based on a forward rotation of the wheel, and wherein the airflow through the suction nozzle is increased based on a reverse rotation of the wheel. In another aspect, alone or in combination with any one of the previous aspects or any combination thereof, the airflow through the suction nozzle is increased and the distribution of the solution to the surface is decreased when the signal indicates movement in the reverse direction. In another aspect, alone or in combination with any one of the previous aspects or any combination thereof, the signal includes output from two sensors, wherein the controller is configured to determine a direction of motion based on which sensor output the controller receives first. In another aspect, alone or in combination with any one of the previous aspects or any combination thereof, the extractor further comprises a valve assembly in fluid communication with the supply tank for selectively delivering the solution.

In another embodiment, a method for distributing a solution to a surface to be cleaned using an extractor is provided, the method comprising: detecting, with an encoder, a user-initiated movement of a base of the extractor along the surface during operation of the extractor; generating a signal based on detection of the user-initiated movement of the base along the surface; receiving the signal at a controller of the extractor; and in response receiving the signal, distributing the solution to the surface based on the signal during operation of the extractor, wherein distribution of the solution is independent of user interaction with the extractor other than the user-initiated movement. In one aspect, initiating the distribution of the solution to the surface is not dependent on continual actuation by a user of a user interface connected to a liquid distribution system. In another aspect, alone or in combination with any one of the previous aspects or any combination thereof, distributing the solution to the surface further comprises distributing the solution to the surface when the signal indicates user-initiated forward movement. In another aspect, alone or in combination with any one of the previous aspects or any combination thereof, the method further comprises: receiving an actuation of a switch; and in response to receiving the actuation of the switch, discontinuing a flow of the solution during the user-initiated forward movement. In another aspect, alone or in combination with any one of the previous aspects or any combination thereof, distributing the solution to the surface further comprises interrupting the distribution of the solution to the surface when the signal indicates user-initiated reverse movement. In another aspect, alone or in combination with any one of the previous aspects or any combination thereof, the method further comprises the step of controlling a brush motor based on the signal during operation of the extractor. In yet another aspect, alone or in combination with any one of the previous aspects or any combination thereof, the method further comprises the step of controlling a suction motor based on the signal during operation of the extractor.

In another aspect, alone or in combination with any one of the previous aspects or any combination thereof, the base further comprises at least one wheel, and wherein detecting, with an encoder further comprises determining a rotation of the at least one wheel and generating the signal based on rotation of the at least one wheel. In another aspect, alone or in combination with any one of the previous aspects or any combination thereof, distributing the solution to the surface further comprises: initiating the distribution of the solution when the signal indicates forward rotation of the at least one wheel; and interrupting the distribution of the solution when the signal indicates reverse rotation of the at least one wheel. In another aspect, alone or in combination with any one of the previous aspects or any combination thereof, continued distribution of the solution to the surface is based on continued generation of the signal during operation of the extractor. In another aspect, alone or in combination with any one of the previous aspects or any combination thereof, the signal is indicative of a speed of movement of the base, and wherein distributing the solution further comprises increasing or decreasing a rate of the distribution of the solution according to a respective increase or decrease of the speed of forward movement during operation of the extractor.

In yet another embodiment, a method for distributing a solution to a surface to be cleaned using an extractor is provided, the method comprising: detecting, with an encoder, a user-initiated movement of a base of the extractor along the surface during operation of the extractor; generating an encoder signal based on detection of the user-initiated movement of the base along the surface, wherein the encoder signal is a first signal based on user-initiated movement of the base along the surface in a forward direction and a second signal based on user-initiated movement of the base along the surface in a rearward direction; receiving the encoder signal at a controller of the extractor, the controller being configured to operate a liquid distribution system in a distributing mode during movement of the base based on the first signal during operation of the extractor and in a non-distributing mode during movement of the base based on the second signal during operation of the extractor; and in response receiving the encoder signal, operating the liquid distribution system to distribute the solution to the surface based on the encoder signal during operation of the extractor, wherein a change from the distributing mode to the non-distributing mode is based on the encoder signal and independent of user interaction with the extractor other than the user-initiated movement. In one aspect, initiating the distribution of the solution to the surface is not dependent on continual actuation by a user of a user interface connected to the liquid distribution system. In another aspect, alone or in combination with any one of the previous aspects or any combination thereof, the method further comprises: receiving an actuation of a switch; and in response to receiving the actuation of the switch, discontinuing a flow of the solution during the user-initiated movement in the forward direction. In another aspect, alone or in combination with any one of the previous aspects or any combination thereof, distributing the solution to the surface further comprises interrupting the distribution of the solution to the surface when the encoder signal indicates the user-initiated movement in the rearward direction.

In another aspect, alone or in combination with any one of the previous aspects or any combination thereof, the base further comprises at least one wheel, and wherein the step of generating an encoder signal includes generating the first signal based on a forward rotation of the at least one wheel, and generating the second signal based on a reverse rotation of the at least one wheel. In another aspect, alone or in combination with any one of the previous aspects or any combination thereof, distributing the solution to the surface further comprises: initiating the distribution of the solution when the first signal indicates forward rotation of the at least one wheel; and interrupting the distribution of the solution when the second signal indicates reverse rotation of the at least one wheel. In another aspect, alone or in combination with any one of the previous aspects or any combination thereof, continued distribution of the solution to the surface is based on continued generation of the encoder signal during operation of the extractor. In another aspect, alone or in combination with any one of the previous aspects or any combination thereof, the encoder signal is indicative of a speed of movement of the base, and wherein distributing the solution further comprises increasing or decreasing a rate of the distribution of the solution according to a respective increase or decrease of the speed of forward movement during operation of the extractor.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. An extractor comprising:

a base movable along a surface to be cleaned;

a handle configured to be gripped by a user to move the base along the surface to be cleaned;

a nozzle in fluid communication with a suction motor configured to generate a suction airflow through the nozzle;

an encoder operable to generate an encoder signal as a first signal based on user-initiated movement of the base along the surface in a forward direction and as a second signal based on user-initiated movement of the base along the surface in a rearward direction; and a controller operatively connected to the encoder and the suction motor, the controller being configured to change a power to the suction motor to a forward power level based on the first signal during operation of the extractor and to a rearward power level based on the second signal during operation of the extractor, wherein the forward power level is less than the rearward power level.

2. The extractor of claim 1, wherein an amount of suction airflow through the nozzle is increased based on the second signal during operation of the extractor.

3. The extractor of claim 1, the base further comprising a brush operatively connected to a brush motor, wherein the controller controls the brush motor based on the encoder signal during operation of the extractor.

4. The extractor of claim 3, wherein the controller increases speed of rotation of the brush based on the first signal during operation of the extractor.

5. The extractor of claim 3, wherein the controller decreases speed of rotation of the brush based on the second signal during operation of the extractor.

6. The extractor of claim 1, the base further comprising at least one wheel, wherein the first signal is based on a forward rotation of the at least one wheel, and wherein the second signal is based on a reverse rotation of the at least one wheel.

7. The extractor of claim 1, wherein the encoder signal includes output from two sensors, wherein the controller is configured to determine the first signal and the second signal based on which sensor output the controller receives first.

8. The extractor of claim 1, wherein the encoder signal is indicative of direction of movement of the base and speed of movement of the base.

9. The extractor of claim 1 further comprising a liquid distribution system including a supply tank and a distributor in fluid communication configured to deliver solution to the surface in a distributing mode and to not deliver the solution to the surface in a non-distributing mode, wherein the controller is further configured to operate the liquid distribution system in the distributing mode during movement of the base based on the first signal during operation of the extractor and in the non-distributing mode during movement of the base based on the second signal during operation of the extractor.

10. The extractor of claim 9 further comprising a valve assembly in fluid communication with the supply tank and the distributor and operatively connected to the controller for selectively delivering the solution to the distributor.

11. The extractor of claim 9, wherein the controller increases or decreases a rate of distribution of the solution according to a respective increase or decrease of speed of forward movement during operation of the extractor.

12. The extractor of claim 9, wherein continued distribution of the solution to the surface is based on continued generation of the first signal during operation of the extractor.

13. The extractor of claim 9, wherein the controller changes from the distributing mode to the non-distributing mode based on the encoder signal and independent of user interaction with the extractor other than the user-initiated movement.

14. The extractor of claim 9, the handle further comprising a grip portion without a trigger or other user interface connected to the liquid distribution system.

15. The extractor of claim 9, wherein distribution of the solution to the surface in the distributing mode is not dependent on continual actuation by the user of a trigger or other user interface connected to the liquid distribution system.

16. The extractor of claim 9 further comprising a switch configured to selectively discontinue flow of the solution during the user-initiated movement in the forward direction.

* * * * *